US006390732B1

(12) United States Patent
Kristensen et al.

(10) Patent No.: US 6,390,732 B1
(45) Date of Patent: May 21, 2002

(54) JACK-UP, MOVABLE DRILLING PLATFORM HAVING A TELESCOPING OUTRIGGER

(75) Inventors: Per Herbert Kristensen, Rykkin; Lars Martin Sørhaug, Nærsnes; Leiken Dahl, Oslo, all of (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 09/600,809

(22) PCT Filed: Feb. 2, 1999

(86) PCT No.: PCT/NO99/00030

§ 371 Date: Jul. 24, 2000

§ 102(e) Date: Jul. 24, 2000

(87) PCT Pub. No.: WO99/40260

PCT Pub. Date: Aug. 12, 1999

(30) Foreign Application Priority Data

Feb. 3, 1998 (NO) ..... 19980474

(51) Int. Cl.[7] ..... E02B 17/00

(52) U.S. Cl. ..... 405/201; 405/203

(58) Field of Search ..... 405/196, 201, 405/203; 114/265; 414/744.6, 749.6; 212/307, 230, 264, 347–350

(56) References Cited

U.S. PATENT DOCUMENTS

| | | | | |
|---|---|---|---|---|
| 3,477,235 A | | 11/1969 | Branham et al. | |
| 4,004,695 A | * | 1/1977 | Hockensmith | 211/349 X |
| 4,068,487 A | * | 1/1978 | Pease et al. | 405/201 |
| 4,401,407 A | * | 8/1983 | Breckenridge | 414/408 |
| 4,483,644 A | | 11/1984 | Johnson | |
| 4,544,135 A | * | 10/1985 | Albaugh | 254/108 |
| 4,602,894 A | | 7/1986 | Lorenz et al. | |
| 5,032,040 A | | 7/1991 | Ingle | |
| 6,171,027 B1 | * | 1/2000 | Blankestijin | 405/201 |

* cited by examiner

*Primary Examiner*—David Bagnell
*Assistant Examiner*—Sunil Singh
(74) *Attorney, Agent, or Firm*—Birch, Stewart, Kolasch & Birch, LLP

(57) ABSTRACT

A jack-up, movable drilling platform comprises a telescopic outrigger structure which is movable between a retracted position where it is located above the drilling platform's deck and an extended position where it projects outwards and away from the deck, and a drilling rig which is securely attached to the outrigger structure.

29 Claims, 6 Drawing Sheets

JACK-UP, MOVABLE DRILLING PLATFORM HAVING A TELESCOPING OUTRIGGER

This application is the national phase under 35 U.S.C. § 371 of PCT International Application No. PCT/NO99/00030 which has an International filing date of Feb. 2, 1999, which designated the United States of America.

1. Field of the Invention

The invention concerns a jack-up, movable drilling platform, comprising a deck, a drilling rig and a substructure.

2. Description of the Related Art

Jack-up, movable drilling platforms are employed for offshore oil and gas drilling, and may also be used in drilling injection wells. This type of platform has pontoons and a substructure in the form of collapsible legs. The platforms normally have a main deck where the drilling rig is located, and often also include an accommodation module, hoisting cranes, a helicopter deck and necessary processing equipment for handling oil and gas which flows out of the well during drilling.

During operation the platform is moved to a drilling field where the legs are unfolded, or more correctly, the platform is jacked up along the legs. One or more wells are then drilled with the drilling rig. If several wells are drilled, which is usually the case, the drilling rig is pushed or pulled into a new position on the main deck for drilling a new well. This makes it possible to drill several wells without moving the platform, but the number of positions for drilling wells is naturally limited by the size of the main deck. If more wells require to be drilled, the platform has to be moved, which is a time-consuming and costly operation.

Since it is often desirable to drill more wells than is possible without moving the drilling platform, there is consequently a need for a drilling platform on which it is possible to drill more wells than from the known drilling platforms.

BRIEF SUMMARY OF THE INVENTION

The object of the invention is to provide a jack-up, movable drilling platform where the drilling rig can be moved to a greater number of positions for drilling than is the case on known jack-up, movable drilling platforms.

The object is achieved according to the invention with a jack-up, movable drilling platform.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in more detail in connection with a description of a specific embodiment, and with reference to the drawings which are given by way of illustration only, and thus are not limitative of the present invention, and in which.

DETAILED DESCRIPTION OF THE INVENTION

Figure 1:
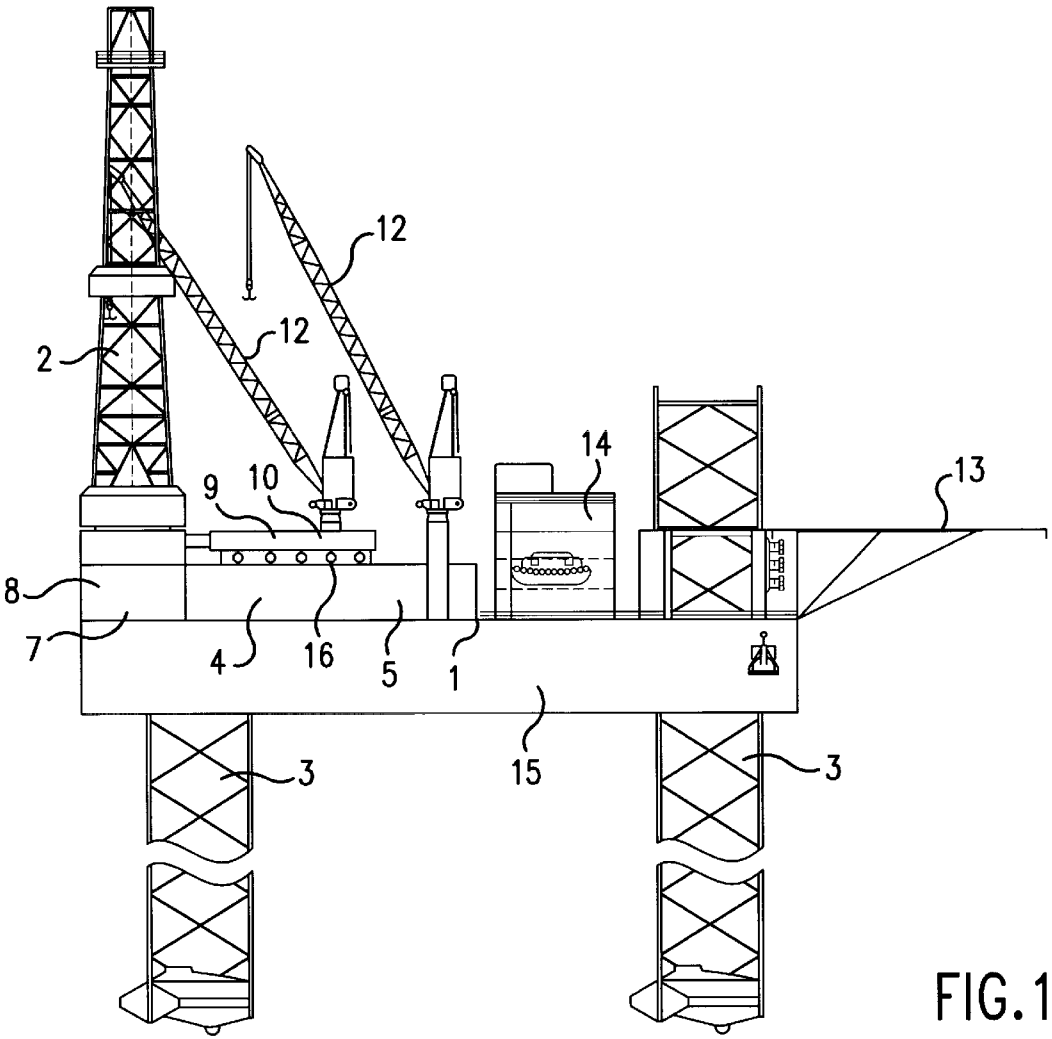
FIG. 1 is an elevational view of a drilling platform according to the invention where an outrigger structure is located in a retracted position.
Figure 2:
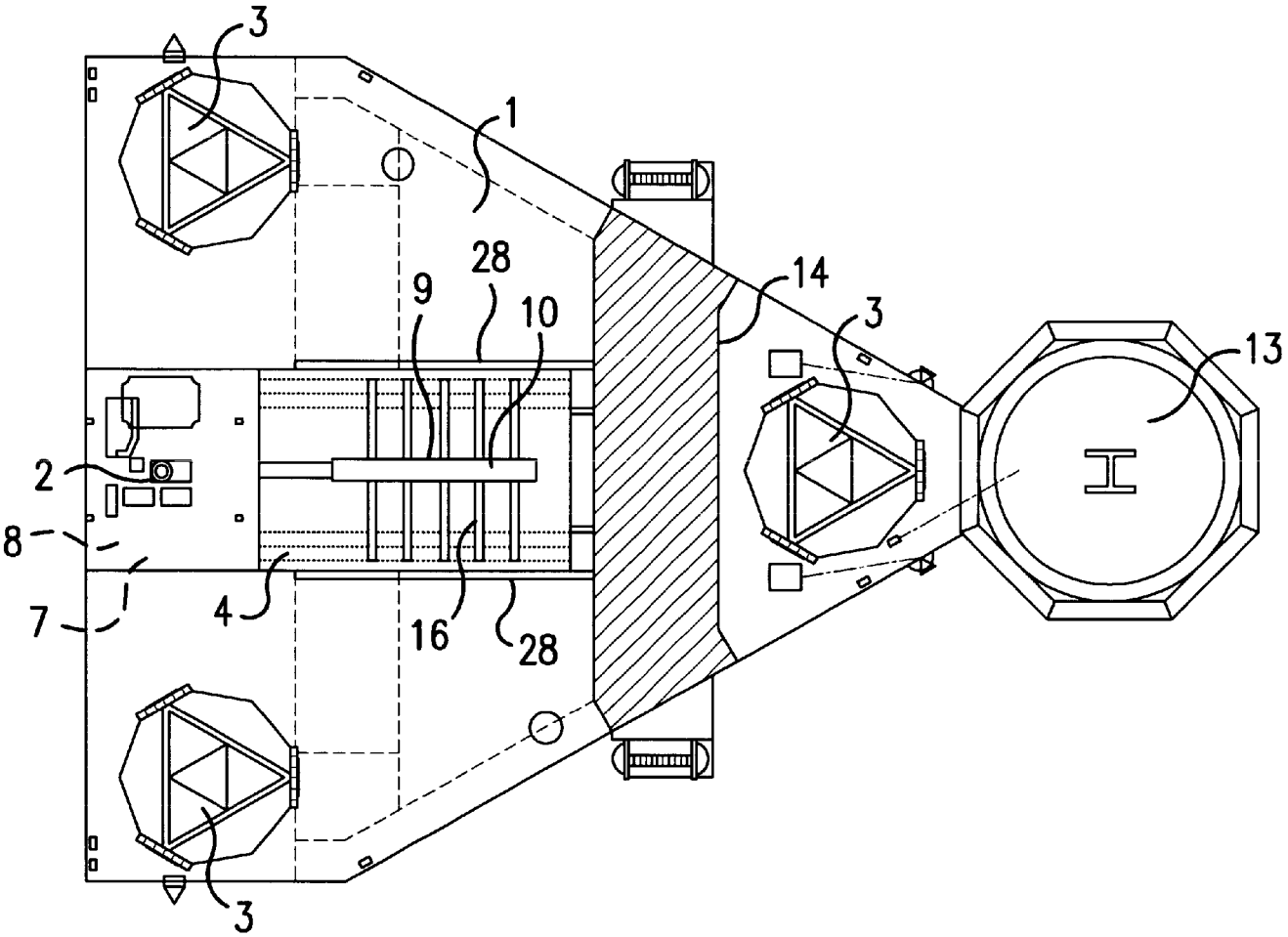
FIG. 2 is a top view of the drilling platform in FIG. 1.

FIGS. 1 and 2 are elevational view and a top view respectively of a jack-up, movable drilling platform according to the invention, comprising a deck 1, a drilling rig 2 and a substructure 3 in the form of three legs. By means of the drilling rig 2 wells can be drilled in the known manner for recovery of oil and gas or injection of gas or water. The drilling platform further comprises hoisting cranes 12, a helicopter deck 13, an accommodation module 14 and pontoons 15. In addition the drilling platform includes necessary not shown processing equipment for handling oil and gas which flows out of the well during drilling. The drilling rig 2 is located on and secured to an external portion of a telescopic outrigger structure 4, which in FIGS. 1 and 2 is shown in a retracted position where the drilling rig 2 is located above or inside the deck 1.

Figure 3:
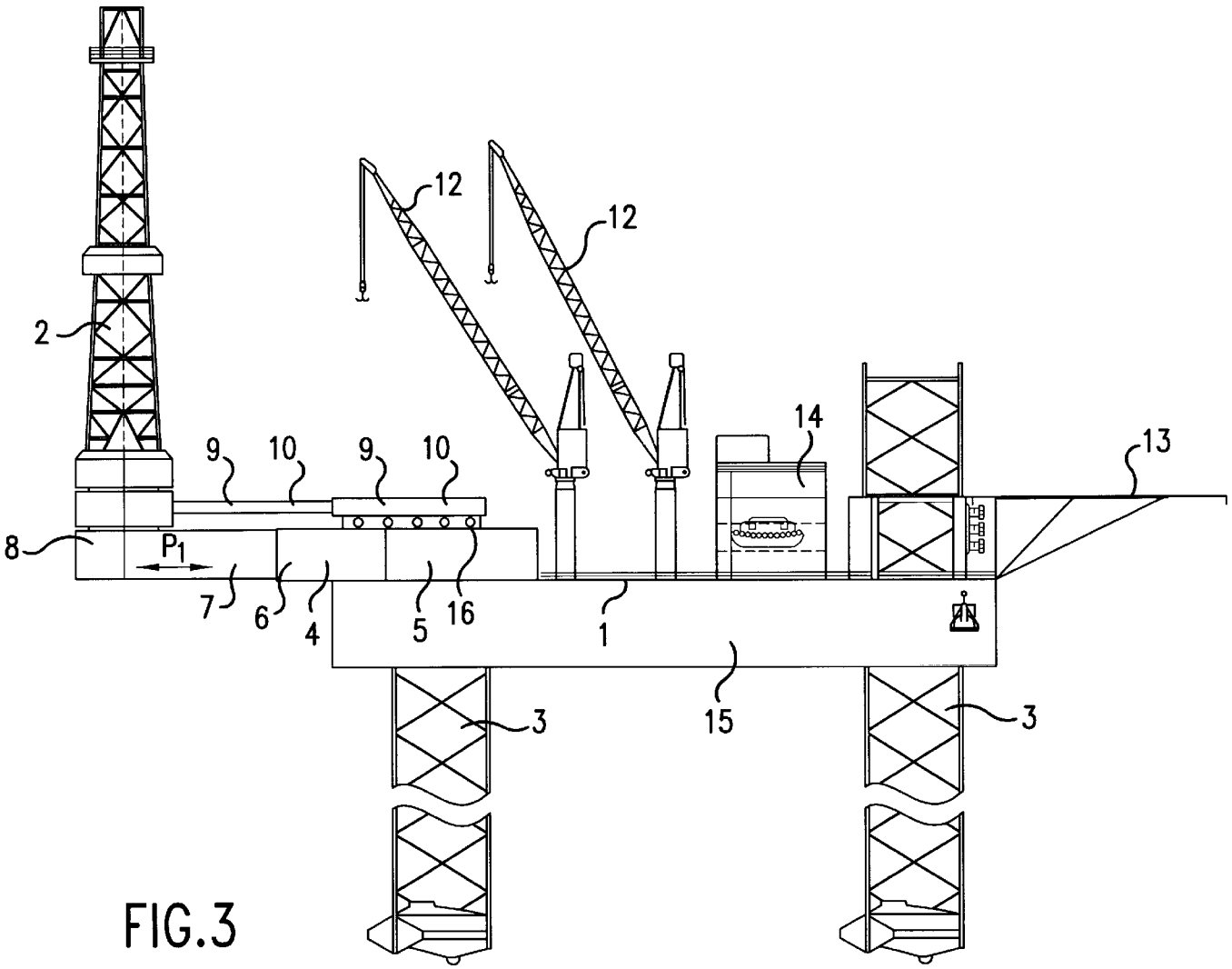
FIG. 3 is an elevational view of a drilling platform according to the invention where the outrigger structure is located in an extended position.
Figure 4:
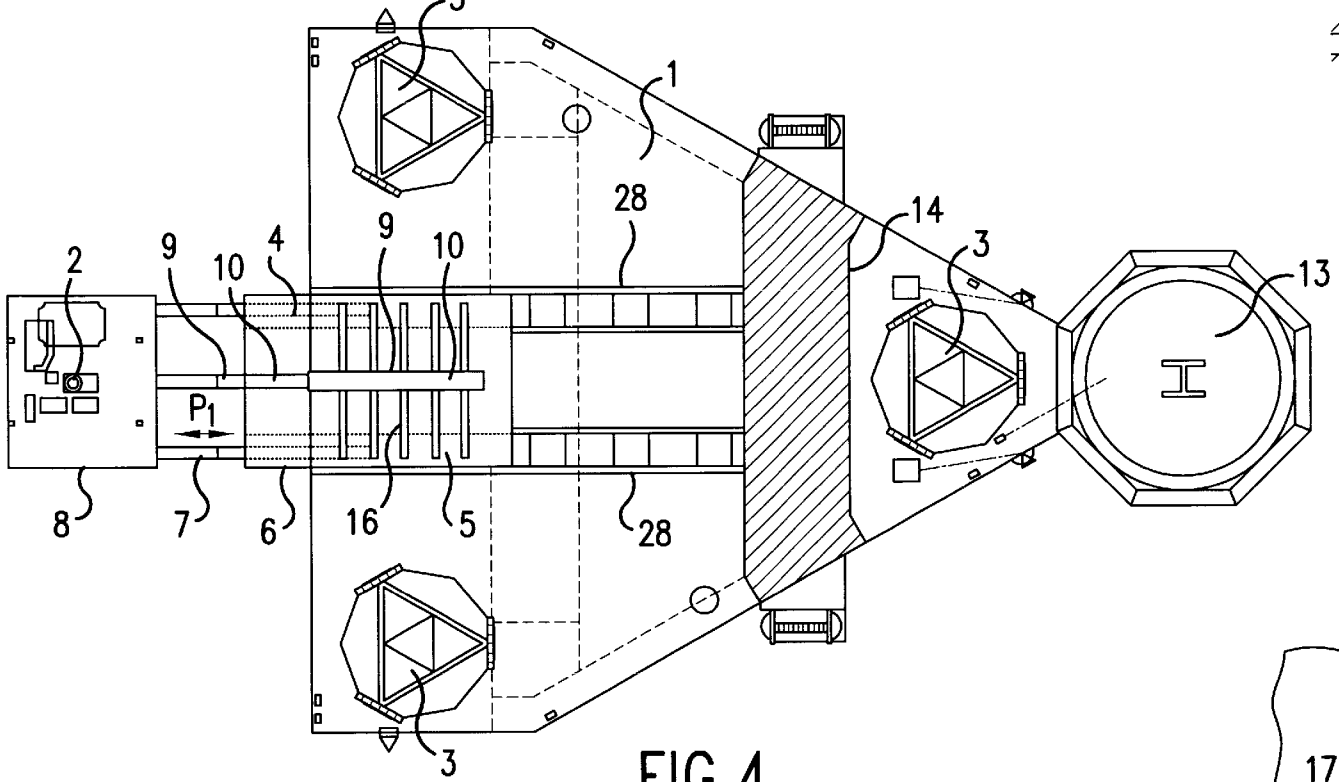
FIG. 4 is a top view of the drilling platform in FIG. 3.

FIGS. 3 and 4 are an elevational view and a top view respectively of the same drilling platform where the telescopic outrigger structure 4 is shown in an extended position, and the drilling rig 2 is located outside the deck. The drilling rig 2 can thereby drill wells from a position which is located outside the deck 1, with the result that more wells can be drilled than if the drilling rig 2 had only been able to be moved within the confines of the deck 1.

The outrigger structure 4 consists of an inner arm 5 which is movably attached to the deck 1 for movement in a direction $P_1$, see FIGS. 3 and 4. In FIGS. 1 and 2, where the outrigger structure 4 is located in its retracted position, the inner arm 5 is located entirely above or inside the deck 1. In the outrigger structure's extended position illustrated in FIGS. 3 and 4 the inner arm 5 is located partly inside the deck 1, and partly outside, with an external portion 6 of the inner arm 5 projecting outwards and away from the deck 1.

The outrigger structure 4 further comprises an outer arm 7 which is movably attached to the inner arm 5 for movement in the same direction $P_1$. The outer arm 7 is movable between a retracted position illustrated in FIGS. 1 and 2 where, except for an external portion 8, it is located inside the inner arm 5, and an extended position illustrated in FIGS. 3 and 4 where it is located partly outside the inner arm 5 and projects away from the deck 1. The drilling rig 2 is securely attached to the outer arm's external portion 8, and is located in the position illustrated in FIGS. 1 and 2 inside the deck 1, while in the position illustrated in FIGS. 3 and 4 it is located furthest away from the drilling platform.

The outrigger structure 4 also comprises a telescopically movable pipe bridge 9 for transferring drill pipes and casings between the deck 1 and the drilling rig 2. The telescopic retraction and extension of the pipe bridge 9 accompanies the telescopic retraction and extension of the outrigger structure 4, in the direction $P_1$. The pipe bridge 9 is thus shown in its retracted position in FIGS. 1 and 2, and in its extended position in FIGS. 3 and 4. The pipe bridge is located on top of the outrigger structure 4 and securely attached thereto, and apart from its telescopic construction is of a known type.

The outrigger structure 4 also includes a telescopically movable gangway 10 for connection between the deck 1 and the drilling rig 2. The telescopic retraction and extension of the gangway 10 also accompanies the telescopic retraction and extension of the outrigger structure 4 in the direction $P_1$, and the gangway's retracted and extended positions consequently also conform with the corresponding positions of the outrigger structure. The gangway 10 is located on top of the outrigger structure 4 and is securely attached thereto. In the illustrated embodiment the pipe bridge 9 and the gangway 10 are designed as a joint unit, but they may also be separate.

In connection with the pipe bridge and the gangway there are also illustrated guide rails 16, which will be described in more detail in connection with FIG. 7.

Figure 5:
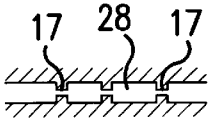
FIG. 5 illustrates a rail with a gripping notch for use in the invention.

FIG. 4 also illustrates two rails 28 in the deck 1, arranged in extension of the inner arm 5. The rail 28 is shown in closer detail in FIG. 5, where it shows how it includes gripping notches 17 for co-operation with jack attachment points.

Figure 6:
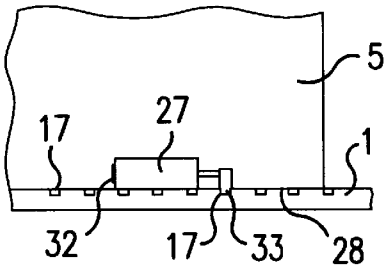
FIG. 6 illustrates a jack for use in the invention.

FIG. 6 illustrates a jack 27. The jack is attached to the inner arm 5 at a jack point 32, and by means of a second jack point 33 grips the gripping notches 17. By alternately jacking up and moving the jack point 33 along the rail 28, an intermittent shifting of the inner arm 5 relative to the deck 1 is achieved. By means of not shown corresponding jacks and gripping grooves an intermittent shifting of the outer arm 7 relative to the inner arm 5 is achieved.

Figure 7:
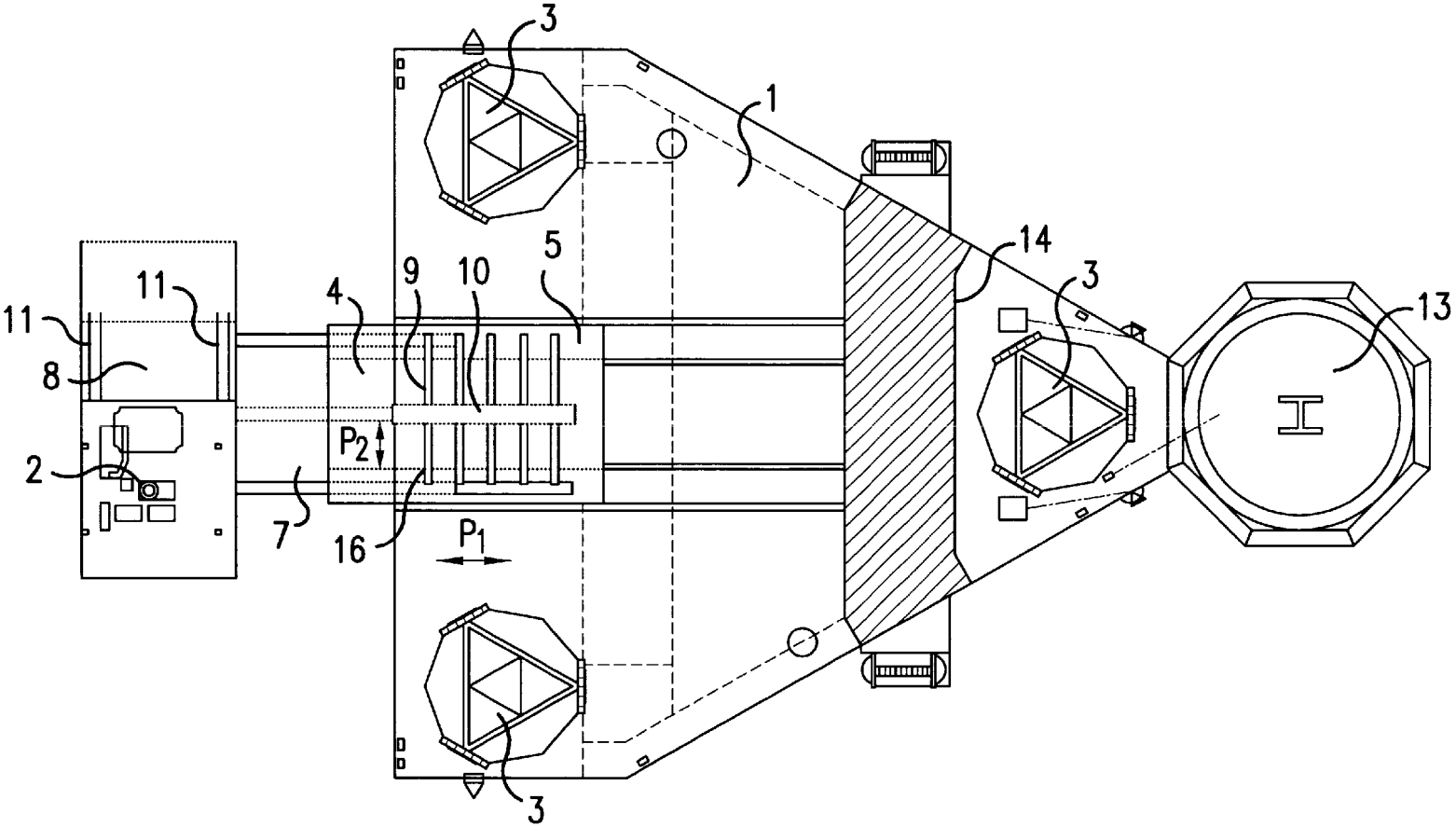
FIG. 7 is a top view of a preferred embodiment of a drilling platform according to the invention with the outrigger structure in an extended position.

FIG. 7 illustrates how the external portion 8 of the outer arm 7 comprises a rail system 11 for moving the drilling rig 2 in a direction $P_2$ perpendicular to the inner arm's and the outer arm's direction of movement $P_1$. In comparison with an embodiment where the drilling rig is only movable in the direction $P_1$, the advantage is achieved that the drilling rig 2 can be located in several positions, thereby making it possible to drill several wells without moving the drilling platform. By means of guide rails 16 the pipe bridge 9 is disposed movably in the direction $P_2$ perpendicular to the inner arm's and the outer arm's direction of movement $P_1$, thus enabling the pipe bridge 9 to accompany the drilling rig 2 as it moves in the direction $P_2$ along the rail system 11. By means of the same guide rails 16 the gangway 10 is also disposed movably in the direction $P_2$ perpendicular to the inner arm's and the outer arm's direction of movement $P_1$, thus enabling the gangway 10 to also accompany the drilling rig 2 as it moves along the rail system 11.

Figure 8:
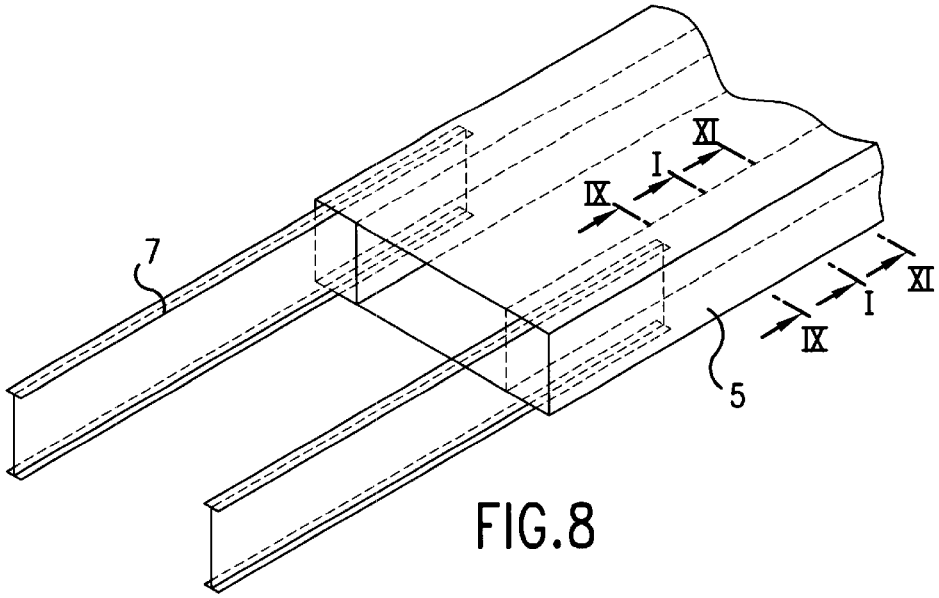
FIG. 8 is a translucent view of a part of the outrigger structure.

FIG. 8 is a translucent view of a part of the outrigger structure 4. This shows how the outer arm 7 comprises two beams which are provided partly inside two beams which form part of the inner arm 5. FIG. 8 illustrates the principle design of the outrigger structure 4, and thus guides for the beams, which will be discussed below, are not shown in FIG. 8.

Figure 9:
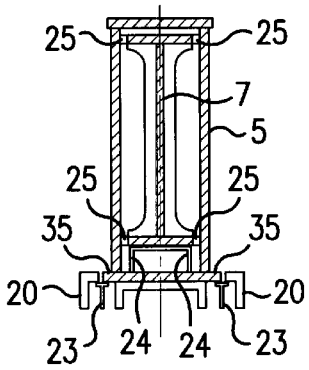
FIG. 9 is a cross section taken along intersecting line IX—IX in FIG. 8.
Figure 10:
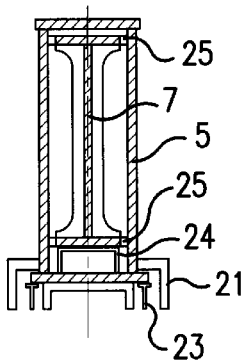
FIG. 10 is a cross section taken along intersecting line X—X in FIG. 8.
Figure 11:
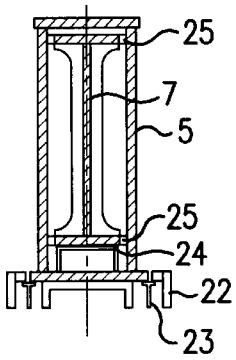
FIG. 11 is a cross section taken along intersecting line XI—XI in FIG. 8.

FIGS. 9, 10 and 11 are cross sections through the beams which form part of the inner arm 5 and the outer arm 7, viewed along intersecting lines IX—IX, X—X and XI—XI respectively in FIG. 8. These figures illustrate how the beams which form part of the inner arm 5 have an open, box-shaped cross section with a lower flange 35, while the beam which forms part of the outer arm 7 has an I-shaped cross section.

FIG. 9 illustrates lateral guides 20 which are attached to the deck and abut against the flange 35 on the beam which forms part of the inner arm 5, thus providing this beam with lateral support. It further illustrates how the lower edge of this beam is supported by lower vertical guides 23 which absorb downwardly directed forces. The beam which forms part of the outer arm 7 is laterally supported by lateral guides 25, and at the lower edge by vertical guides 24, both the lateral guides 25 and the vertical guides 24 being provided inside the beam which forms part of the inner arm 5.

FIG. 10 illustrates how the beam which forms part of the inner arm 5 in section X—X is supported by upper vertical guides 21, which absorb upwardly directed forces. The lower vertical guides 23 for the beam which forms part of the inner arm 5 and the lateral guides 25 and the vertical guides 24 for the beam which forms part of the outer arm 7 are of the same type as in FIG. 9.

FIG. 11 shows combined lateral guides and locks 22, which, apart from having the same function as the lateral guides 20, can also secure the beam which forms part of the inner arm 5, thus enabling the inner arm 5 to be locked in the desired position.

Figure 12:
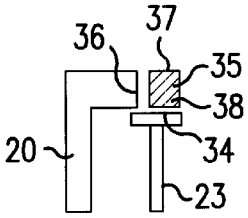
FIG. 12 shows a detail of a guide in FIG. 9.

FIG. 12 shows the lateral guide 20 and the lower vertical guide 23 in closer detail, and illustrates how the lateral guide 20 and the lower vertical guide 23 are located with contact faces 36 and 34 respectively abutting against corresponding contact faces 37 and 38 respectively on the flange 35.

Figure 13:
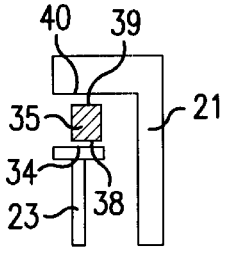
FIG. 13 shows a detail of a guide in FIG. 10.

FIG. 13 shows the upper vertical guide 21 in FIG. 10 in closer detail, and illustrates how it is located with a contact face 40 abutting against a corresponding contact face 39 on the flange 35. The lower vertical guide 23 is of the same type as illustrated in FIG. 12.

Figure 14:
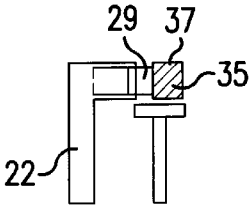
FIG. 14 shows a detail of a guide in FIG. 11.

FIG. 14 illustrates a detail of the combined lateral guide and lock 22 in FIG. 11. It shows how it comprises a lock shoe 29, which may be hydraulically operated, and which abuts against the contact face 37 on the flange 35, holding it securely.

Figure 15:
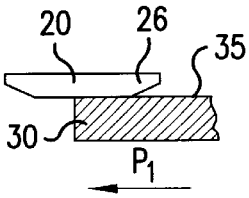
FIG. 15 shows a guide viewed from above.

FIG. 15 shows a guide 20 viewed from above. It illustrates how this is provided with outwardly facing angled end sections 26, thus forming angled surfaces which, when the beam which forms part of the inner arm 5 is moved outwards or inwards on the deck 1, will guide end portions 30 of the flange 35 into position against the guide 20, thus guiding the inner arm 5 in the direction $P_1$.

The beam which forms part of the outer arm 7 will be provided with guides and lock shoe corresponding to those described in the above and illustrated in FIGS. 12–15, in order to guide and to be able to secure the outer arm 7 relative to the inner arm 5. For both the inner arm and the outer arm the guides will be placed at predetermined intervals along the longitudinal direction of the inner arm and the outer arm respectively.

In an actual embodiment of the outrigger structure 4 the extent and direction of the forces acting on the inner arm's and the outer arm's different guides will have to be determined by an analysis of the actual design, and the choice of the type of guides and their sizing in the various positions along the beams which form part of the inner arm and the outer arm will have to be selected on this basis. Thus the position of the sections IX—IX, X—X and XI—XI should be regarded as exemplifications.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jack-up, movable drilling platform, comprising:

a deck;

a drilling rig;

a substructure, a telescopic outrigger structure with an inner arm which is attached to the deck movable in a direction between a retracted position located above the deck and an extended position where an external portion of the inner arm projects outwards and away from the deck; and an outer arm attached to the inner arm, the outer arm being movable in the same direction between a retracted position located substantially retracted into the inner arm and an extended position where an external portion of the outer arm projects away from the inner arm, the drilling rig being securely attached to the external portion of the outer arm and the telescopic outrigger structure having a telescopically movable pipe bridge for transferring drill pipes and casings between the deck and the drilling rig.

2. The platform according to claim 1, wherein the telescopic outrigger structure comprises a telescopically movable gangway for connection between the deck and the drilling rig.

3. The platform according to claim 2, wherein the gangway is disposed movably in a direction perpendicular to the direction of movement of the inner arm and the outer arm.

4. The platform according to claim 1, wherein the external portion of the outer arm comprises a rail system for moving the drilling rig in a direction perpendicular to the direction of movement of the inner arm and the outer arm.

5. The platform according to claim 1, wherein the pipe bridge is disposed movable in the direction perpendicular to the direction of movement of the inner arm and the outer arm.

6. The platform according to claim 1, wherein the inner arm comprises beams with an open cross section arranged to co-operate with a number of guides disposed on the deck, the outer arm comprising beams which are arranged inside the beams of the inner arm, the beams of the outer arm are arranged to co-operate with a number of guides disposed inside the beams of the inner arm.

7. The platform according to claim 6, wherein the guides of the inner arm are provided with outwardly facing angled end sections to guide end portions of flanges of the inner arm upon movement thereof.

8. The platform according to claim 1, wherein the telescopic outrigger structure comprises jacks and co-operating gripping notches for intermittent moving of the inner arm.

9. The platform according to claim 1, wherein the telescopic outrigger structure comprises locks for securing the inner arm and the outer arm.

10. A jack-up, movable drilling platform, comprising:

a deck;

a drilling rig;

a substructure, a telescopic outrigger structure with an inner arm which is attached to the deck movable in a direction between a retracted position located above the deck and an extended position where an external portion of the inner arm projects outwards and away from the deck; and an outer arm attached to the inner arm, the outer arm being movable in the same direction between a retracted position located substantially retracted into the inner arm and an extended position where an external portion of the outer arm projects away from the inner arm, the drilling rig being securely attached to the external portion of the outer arm and the telescopic outrigger structure comprises a telescopically movable gangway for connection between the deck and the drilling rig.

11. The platform according to claim 10, wherein the external portion of the outer arm comprises a rail system for moving the drilling rig in a direction perpendicular to the direction of movement of the inner arm and the outer arm.

12. The platform according to claim 10, wherein the gangway is disposed movably in a direction perpendicular to the direction of movement of the inner arm and the outer arm.

13. The platform according to claim 10, wherein the inner arm comprises beams with an open cross section arranged to co-operate with a number of guides disposed on the deck, the outer arm comprising beams which are arranged inside the beams of the inner arm, the beams of the outer arm are arranged to co-operate with a number of guides disposed inside the beams of the inner arm.

14. The platform according to claim 13, wherein the guides of the inner arm are provided with outwardly facing angled end sections to guide end portions of flanges of the inner arm upon movement thereof.

15. The platform according to claim 10, wherein the telescopic outrigger structure comprises jacks and co-operating gripping notches for intermittent moving of the inner arm.

16. The platform according to claim 10, wherein the telescopic outrigger structure comprises locks for securing the inner arm and the outer arm.

17. A jack-up, movable drilling platform, comprising:

a deck;

a drilling rig;

a substructure, a telescopic outrigger structure with an inner arm which is attached to the deck movable in a direction between a retracted position located above the deck and an extended position where an external portion of the inner arm projects outwards and away from the deck; and an outer arm attached to the inner arm, the outer arm being movable in the same direction between a retracted position located substantially retracted into the inner arm and an extended position where an external portion of the outer arm projects away from the inner arm, the drilling rig being securely attached to the external portion of the outer arm, the telescopic outrigger structure comprises a telescopically movable pipe bridge for transferring drill pipes and casings between the deck and the drilling rig, the telescopic outrigger structure further comprising a telescopically movable gangway for connection between the deck and the drilling rig, the pipe bridge and the gangway being designed as a joint unit.

18. The platform according to claim 17, wherein the external portion of the outer arm comprises a rail system for moving the drilling rig in a direction perpendicular to the direction of movement of the inner arm and the outer arm.

19. The platform according to claim 17, wherein the pipe bridge is disposed movable in the direction perpendicular to the direction of movement of the inner arm and the outer arm.

20. The platform according to claim 17, wherein the gangway is disposed movably in a direction perpendicular to the direction of movement of the inner arm and the outer arm.

21. The platform according to claim 17, wherein the inner arm comprises beams with an open cross section arranged to co-operate with a number of guides disposed on the deck, the outer arm comprising beams which are arranged inside the beams of the inner arm, the beams of the outer arm are arranged to co-operate with a number of guides disposed inside the beams of the inner arm.

22. The platform according to claim 21, wherein the guides of the inner arm are provided with outwardly facing angled end sections to guide end portions of flanges of the inner arm upon movement thereof.

23. The platform according to claim 17, wherein the telescopic outrigger structure comprises jacks and co-operating gripping notches for intermittent moving of the inner arm.

24. The platform according to claim 17, wherein the telescopic outrigger structure comprises locks for securing the inner arm and the outer arm.

25. A jack-up, movable drilling platform, comprising:

a deck;

a drilling rig;

a substructure, a telescopic outrigger structure with an inner arm which is attached to the deck movable in a direction between a retracted position located above the deck and an extended position where an external portion of the inner arm projects outwards and away from the deck; and an outer arm attached to the inner arm, the outer arm being movable in the same direction between a retracted position located substantially retracted into the inner arm and an extended position where an external portion of the outer arm projects away from the inner arm, the drilling rig being securely attached to the external portion of the outer arm, the inner arm comprises beams with an open cross section arranged to co-operate with a number of guides disposed on the deck, the outer arm comprising beams which are arranged inside the beams of the inner arm, the beams of the outer arm are arranged to co-operate with a number of guides disposed inside the beams of the inner arm, wherein the guides of the inner arm are provided with outwardly facing angled end sections to guide end portions of flanges of the inner arm upon movement thereof.

26. The platform according to claim 25, wherein the telescopic outrigger structure comprises jacks and co-operating gripping notches for intermittent moving of the inner arm.

27. The platform according to claim 25, wherein the telescopic outrigger structure comprises locks for securing the inner arm and the outer arm.

28. A jack-up, movable drilling platform, comprising:

a deck;

a drilling rig;

a substructure, a telescopic outrigger structure with an inner arm which is attached to the deck movable in a direction between a retracted position located above the deck and an extended position where an external portion of the inner arm projects outwards and away from the deck; and an outer arm attached to the inner arm, the outer arm being movable in the same direction between a retracted position located substantially retracted into the inner arm and an extended position where an external portion of the outer arm projects away from the inner arm, the drilling rig being securely attached to the external portion of the outer arm, the telescopic outrigger structure comprises jacks and co-operating gripping notches for intermittent moving of the inner arm.

29. The platform according to claim 28, wherein the telescopic outrigger structure comprises locks for securing the inner arm and the outer arm.

* * * * *